US012195977B2

(12) United States Patent
Stawychny

(10) Patent No.: US 12,195,977 B2
(45) Date of Patent: Jan. 14, 2025

(54) DEVICE FOR SECURING A GUARDRAIL TO A POUR STOP

(71) Applicant: Steve M. Stawychny, Hoffman Estates, IL (US)

(72) Inventor: Steve M. Stawychny, Hoffman Estates, IL (US)

( * ) Notice: Subject to any disclaimer, the term of this patent is extended or adjusted under 35 U.S.C. 154(b) by 634 days.

(21) Appl. No.: 17/522,162

(22) Filed: Nov. 9, 2021

(65) Prior Publication Data

US 2023/0017137 A1 Jan. 19, 2023

Related U.S. Application Data

(63) Continuation-in-part of application No. 29/800,162, filed on Jul. 19, 2021, now Pat. No. Des. 1,009,601.

(51) Int. Cl.
*E04F 11/18* (2006.01)

(52) U.S. Cl.
CPC ..... *E04F 11/1812* (2013.01)

(58) Field of Classification Search
CPC ... E01F 13/024; E01F 13/026; E01F 15/0461; E04F 11/1812; E04F 11/1846; E04H 17/006; E04H 17/009; E04H 17/08; E04H 17/1417; E04H 17/165; E04H 17/166; E04H 17/18; E04H 17/22
USPC ..... 256/65.14, 68
See application file for complete search history.

(56) References Cited

U.S. PATENT DOCUMENTS

| | | | | |
|---|---|---|---|---|
| 3,756,568 | A * | 9/1973 | Mocny | E04G 21/3242 256/65.1 |
| 3,946,992 | A * | 3/1976 | Elias | E04G 21/3233 248/231.71 |
| 6,439,344 | B1 * | 8/2002 | Cole | A62B 35/0068 52/127.2 |
| 8,827,037 | B2 * | 9/2014 | Chilton | E01F 13/022 182/112 |
| 8,925,904 | B2 * | 1/2015 | Christoffer | E04G 21/3223 182/113 |
| 2012/0205604 | A1 * | 8/2012 | Gutierrez | E04G 21/3242 256/68 |
| 2016/0305152 | A1 * | 10/2016 | Kozyra | E01F 15/0461 |
| 2019/0257111 | A1 * | 8/2019 | Stawychny | E04G 21/3242 |

* cited by examiner

*Primary Examiner* — Michael P Ferguson
*Assistant Examiner* — Zachary A Hall
(74) *Attorney, Agent, or Firm* — Donald G. Flaynik

(57) ABSTRACT

A device for securing multiple sections of a guardrail to a pour stop to ultimately form a guardrail about a predetermined surface includes a base member; a stanchion member or pipe integrally secured to a top wall of a top portion of the base member; and an angle member having a side portion and a top portion with a top wall integrally joined to a bottom wall of the top portion of the base member. The stanchion member slidably receives a tube portion of a guardrail section. The side portion of the angle member includes an outer wall disposed substantially parallel to and separated from an inner wall of a second side portion of the base member, thereby forming a gap for receiving a top portion of a pour stop having a bottom portion secured to a surface outside the predetermined surface enclosed by the pour stop.

19 Claims, 16 Drawing Sheets

DEVICE FOR SECURING A GUARDRAIL TO A POUR STOP

This is a Continuation-In-Part Utility application based on Design application Ser. No. 29/800,162 filed on Jul. 19, 2021.

BACKGROUND OF THE INVENTION

1. Field of the Invention

The present invention relates to a device for securing multiple guardrail sections that form a guardrail about a selected floor or deck surface to a pour stop removably secured to the selected surface. The pour stop receives a deformable material (typically concrete) that ultimately cures or solidifies. The pour stop, upon which the device is removably secured, is typically "L" configured angle iron having dimensions of 4"×4"×¼". However, the configuration, dimensions or materials of construction can vary as long as the pour stop is capable of supporting a relatively heavy device and heavy guardrail section removably secured to the device with both the device and guardrail section being disposed in a substantially vertical orientation. The pour stop is typically secured to a floor structure via bolts inserted through apertures in a horizontal portion of the pour stop. The horizontal portion of the pour stop is separated from poured concrete via a vertical portion of the pour stop that engages and contains flowing concrete within a predetermined perimeter of a floor. The pour stop ultimately forms an edge of cured concrete by preventing differential buckling of the concrete as the flowing concrete engages the vertical portion of the pour stop. All devices used to secure multiple sections of the guardrail are removed before the concrete engages the pour stop.

2. Background of the Prior Art

There is a myriad of known devices used for securing and/or supporting a guardrail about the perimeter of a floor structure or surface to prevent falls from occurring when persons are working near floor or wall openings. Further, pour stops are well known for their use for creating a stopping point to prevent poured concrete from spilling over the ends of a metal deck or floor surface. Pour stops are disposed about a selected floor perimeter before concrete is disposed upon a metal deck or floor surface.

What has not been achieved is the detachable securing of a guardrail to a pour stop instead of using fastening equipment that damage the deck or floor surface when attaching the guardrail to the surface. The guardrail would not damage the deck or floor surface if the guardrail was detachably secured to the pour stop via a device that was detachably secured to the pour stop. A guardrail detachably secured to a pour stop could be removed from the pour stop in a relatively short period of time after a curtain wall or similar element is constructed to close an opening in a floor or wall, thereby preventing persons and/or objects from falling. After removing all guardrail sections and securing devices from the pour stop, concrete or similar deformable material is poured upon the deck or floor surface and maintained within a perimeter defined by the pour stop.

A need exits for a device that detachably secures to a pour stop, whereupon, multiple devices removably receive multiple guardrail sections that form a guardrail about a predetermined surface perimeter of a deck or floor in a relatively short time period.

SUMMARY OF THE INVENTION

It is an object of the present invention to overcome many of the disadvantages associated with prior art devices for securing a guardrail to a defined surface area. Another object of the present invention is to secure a guardrail to a pour stop that maintains a deformable material upon a predetermined surface. A principal object of the present invention is to provide a device that removably receives a section of a guardrail and that removably receives a topo portion of a pour stop. A feature of the device is a "U" configured base member having a bottom wall integrally joined to a top wall of an angle member. Another feature of the device is a side wall of a side portion of the angle member separated from an inner wall of a second side portion of the base member, thereby forming a gap. An advantage of the device is that the gap removably receives a top portion of the pour stop as the device is disposed upon the pour stop.

It is another object of the present invention is to provide a device that removably secures to a pour stop. A feature of the device is a bolt member that slidably inserts through an aperture in a first side portion of the base member, then rotationally inserts through a threaded aperture in the side portion of the angle member. An advantage of the device is that the aperture in the first side portion of the base member and the threaded aperture in the second side portion of the base member cooperate to maintain the bolt member axially aligned with the threaded aperture as the bolt member is forcibly rotated into the threaded aperture, thereby preventing bolt member threads from cross-threading with the inner threads in the side portion of the angle member. Another advantage of the device is that the bolt member removably secures the base member and the angle member to the top portion of the pour stop until the bolt member is rotationally removed from the threaded aperture in the side portion of the angle member, thereby enabling the device to be manually removed from the pour stop.

Still another object of the present invention is to provide a device that secures the position of the bolt member relative to the angle member and the pour stop. A feature of the device is a locking nut rotationally disposed upon a threaded shank portion of the bolt member at a predetermined distance from an end wall of the bolt member that promotes engagement between the end wall of the bolt member and inner wall of the top portion of the pour stop. An advantage of the device is that after the continued rotational insertion of the bolt member into the threaded aperture in the side portion of the angle member ultimately urges the inner wall of the second side portion of the base member into forcible engagement with an outer wall of the top portion of the pour stop. The locking nut is then rotationally urged into forcible engagement with an inner wall of the side portion of the angle member, thereby securing the device upon the pour stop.

Yet object of the present invention is to provide a device that removably and slidably receives a tube portion of a guardrail section. A feature of the device is a stanchion member perpendicularly and integrally secured to a top wall of the base member. Another feature of the device is that the stanchion member is configured and dimensioned to slidably and snugly receive a tube portion of a guardrail section. Yet another feature of the device is a threaded rod that removably secures the tube portion of the guardrail section to the stanchion member of the device via the threaded rod being slidably inserted through an aperture in a central top portion of the tube portion of the guardrail section; then rotationally urging the threaded rod into a threaded aperture in a funnel configured cover of the stanchion member a distance that secures and stabilizes the guard section upon the stanchion member. An advantage of the device is that the guardrail section is removably secured to the stanchion member, thereby allowing either both the guardrail and device to be removed from the pour stop simultaneously, or allowing the guardrail to be removed first from the device followed by the removal of the device from the pour stop.

Yet another object of the present invention is to provide a device that removably and slidably receives tube portions of adjacent tube portions of two separate adjacent guardrail sections. A feature of the device is two stanchion members perpendicularly and integrally secured to a top wall of a base member dimensioned and configured to receive the two stanchion members. Another feature of the device is two bolt members that removably secure respective portions of the base member and side portion of the angle member upon the pour stop. An advantage of the device is that two adjacently disposed tube portions of separate sections of a guardrail can be quickly disposed upon the adjacently disposed stanchion members of the one device, whereby a constant distance separating all adjacently disposed tube portions of adjacent separate guardrail sections is maintained, thereby forming a guardrail having guardrail sections separated a constant distance.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
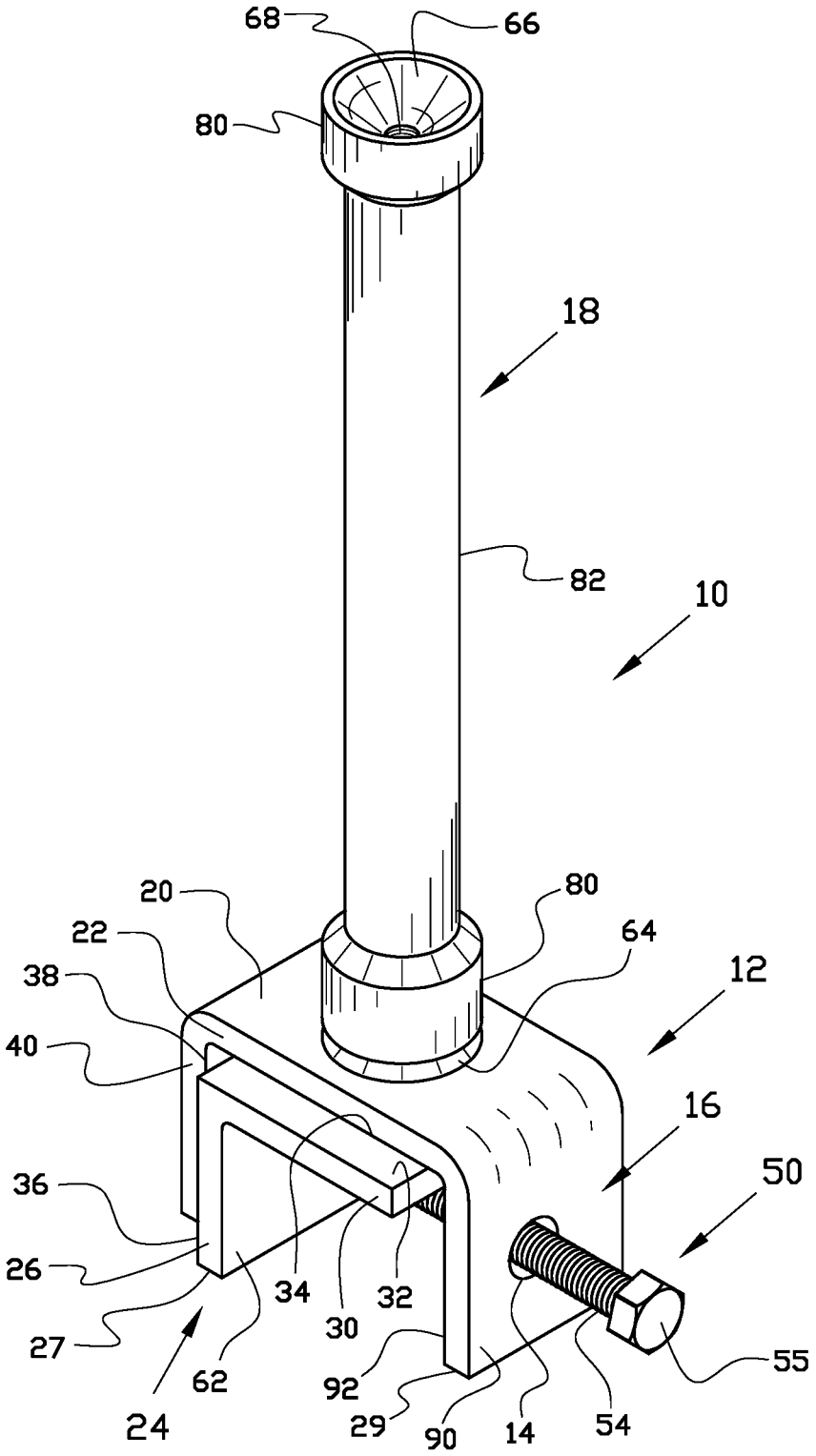
FIG. 1 is a front perspective view of a device for securing a guardrail section to a pour stop in accordance with the present invention.
Figure 1A:
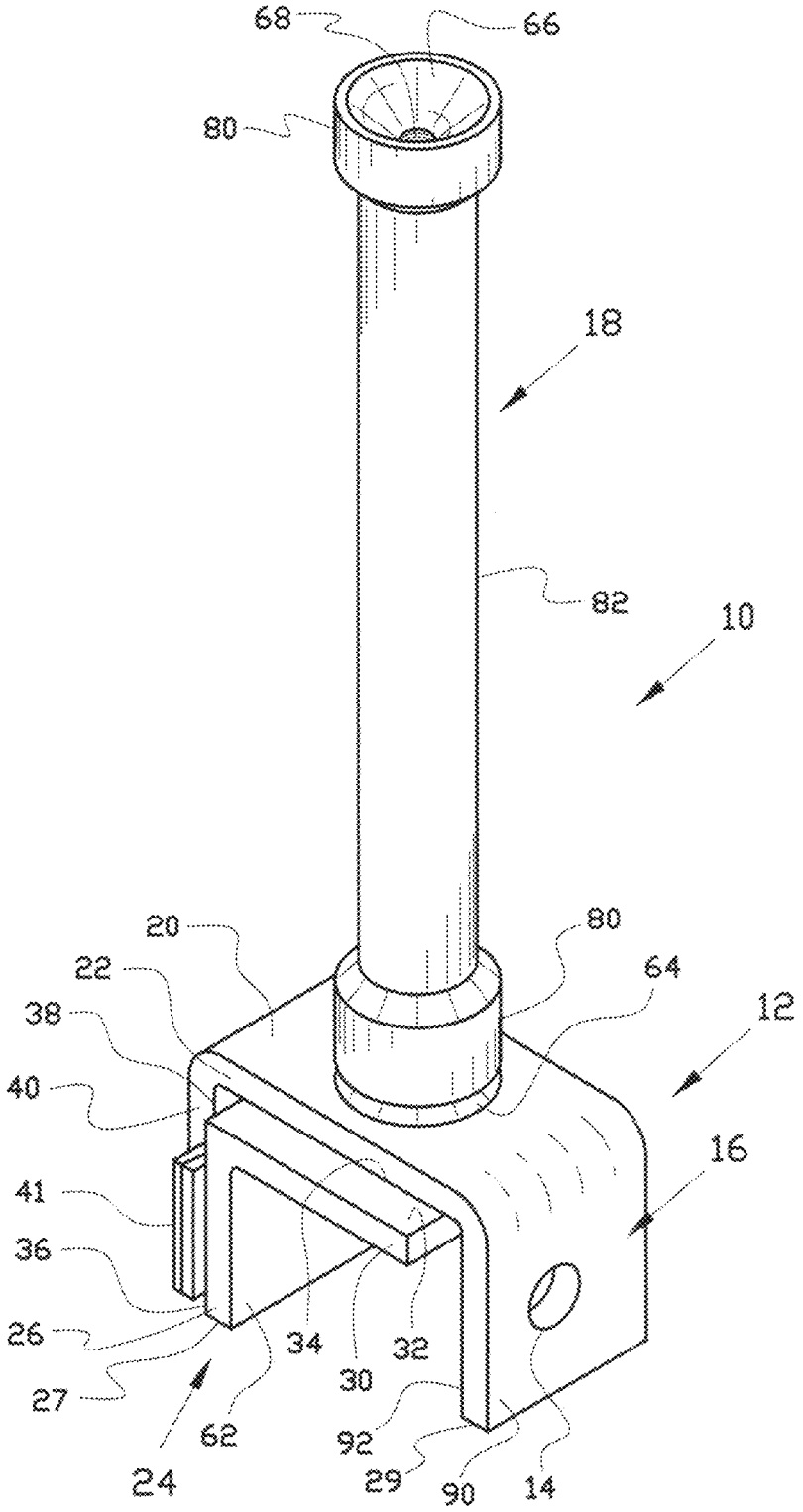
FIG. 1A is the front perspective view of the device of FIG. 1, but with a bolt member removed and shims added.
Figure 2:
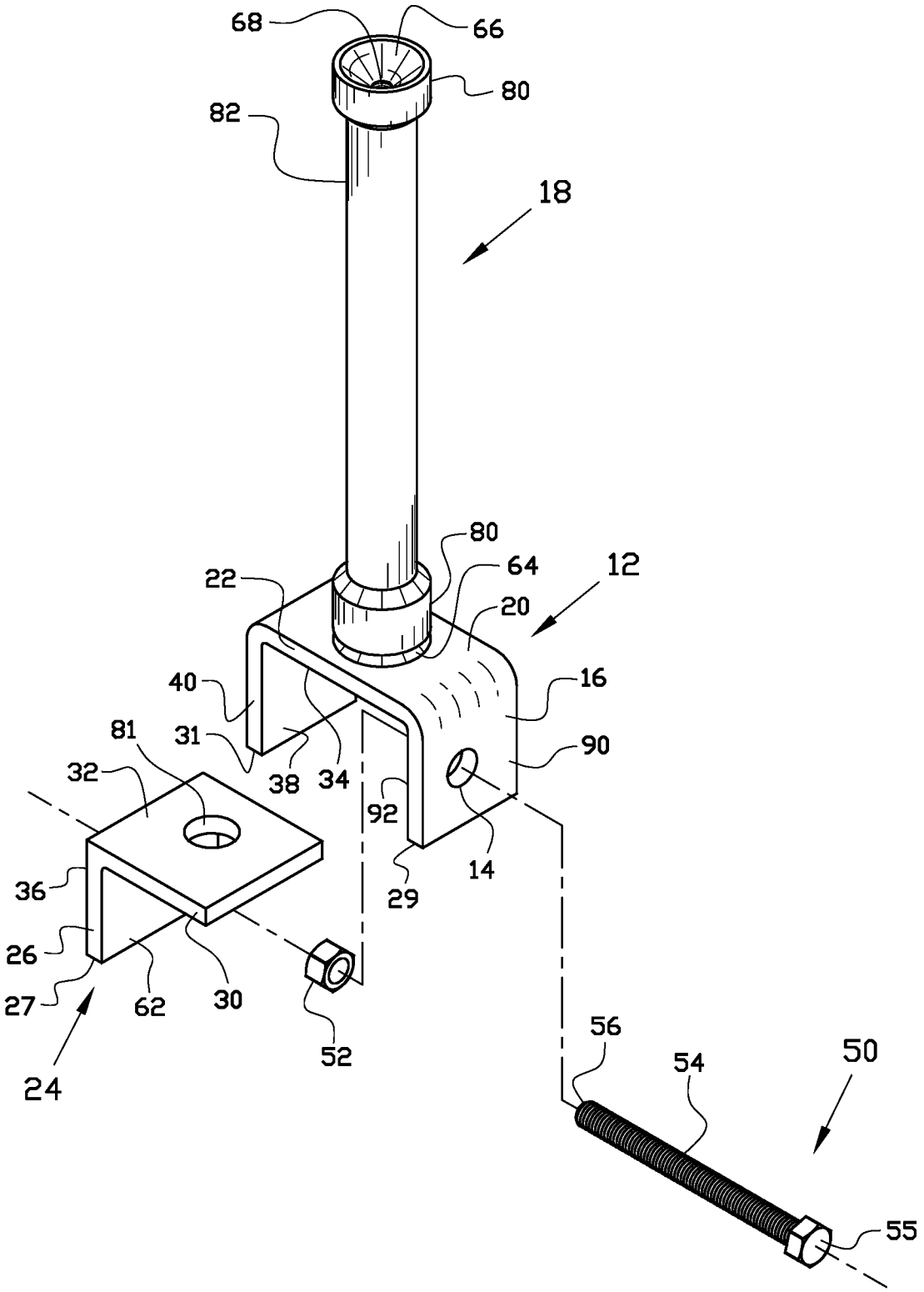
FIG. 2 is an exploded view of the device of FIG. 1.
Figure 3:
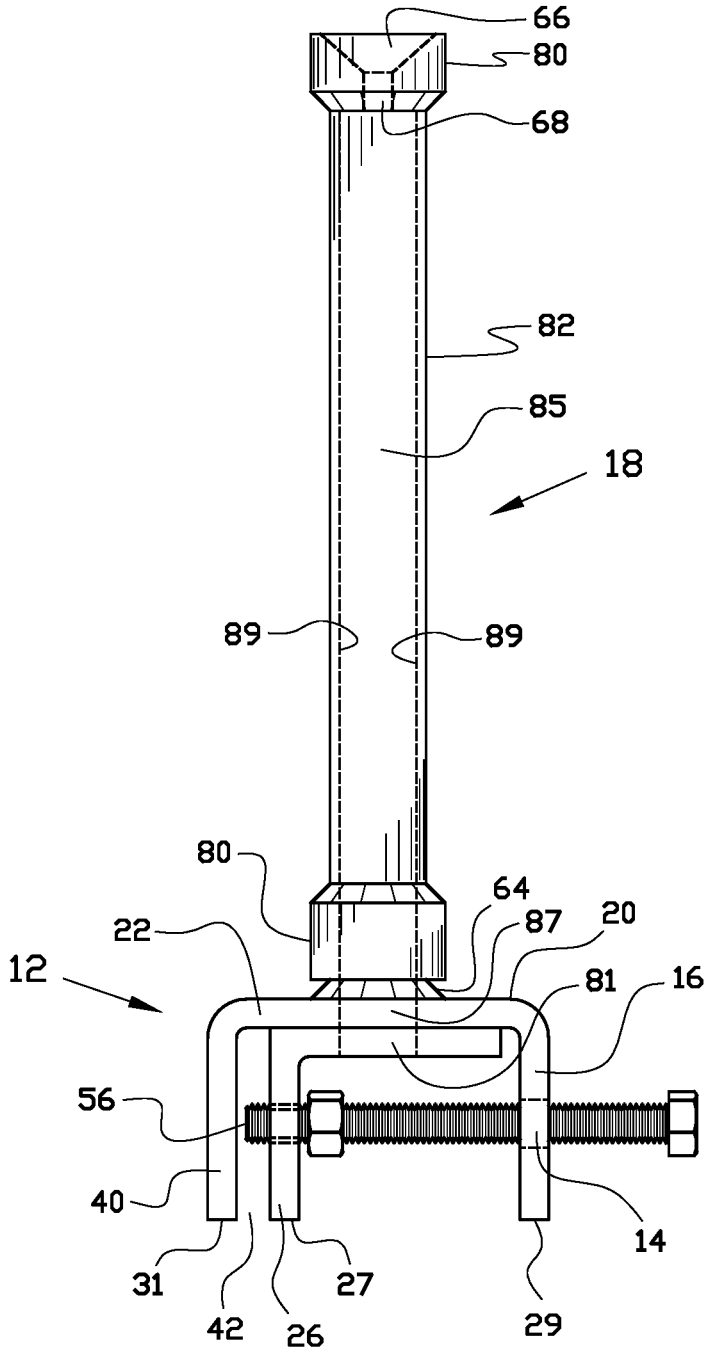
FIG. 3 is a left-side elevation view of the device of FIG. 1.
Figure 3A:
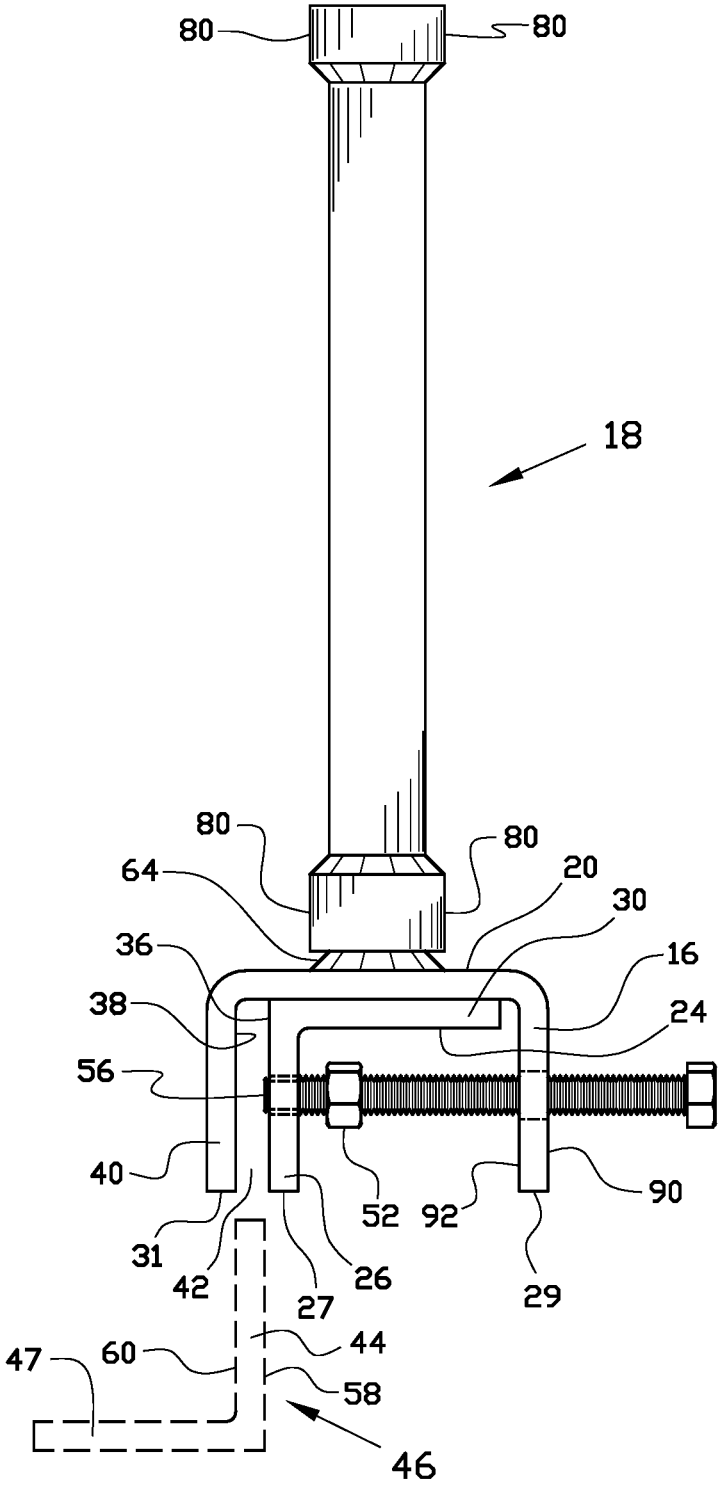
FIG. 3A is a left-side elevation view of the device of FIG. 3 disposed above a pour stop to be inserted into a gap in the device which includes a bolt member having a relatively long axial dimension in accordance with the present invention.
Figure 3B:
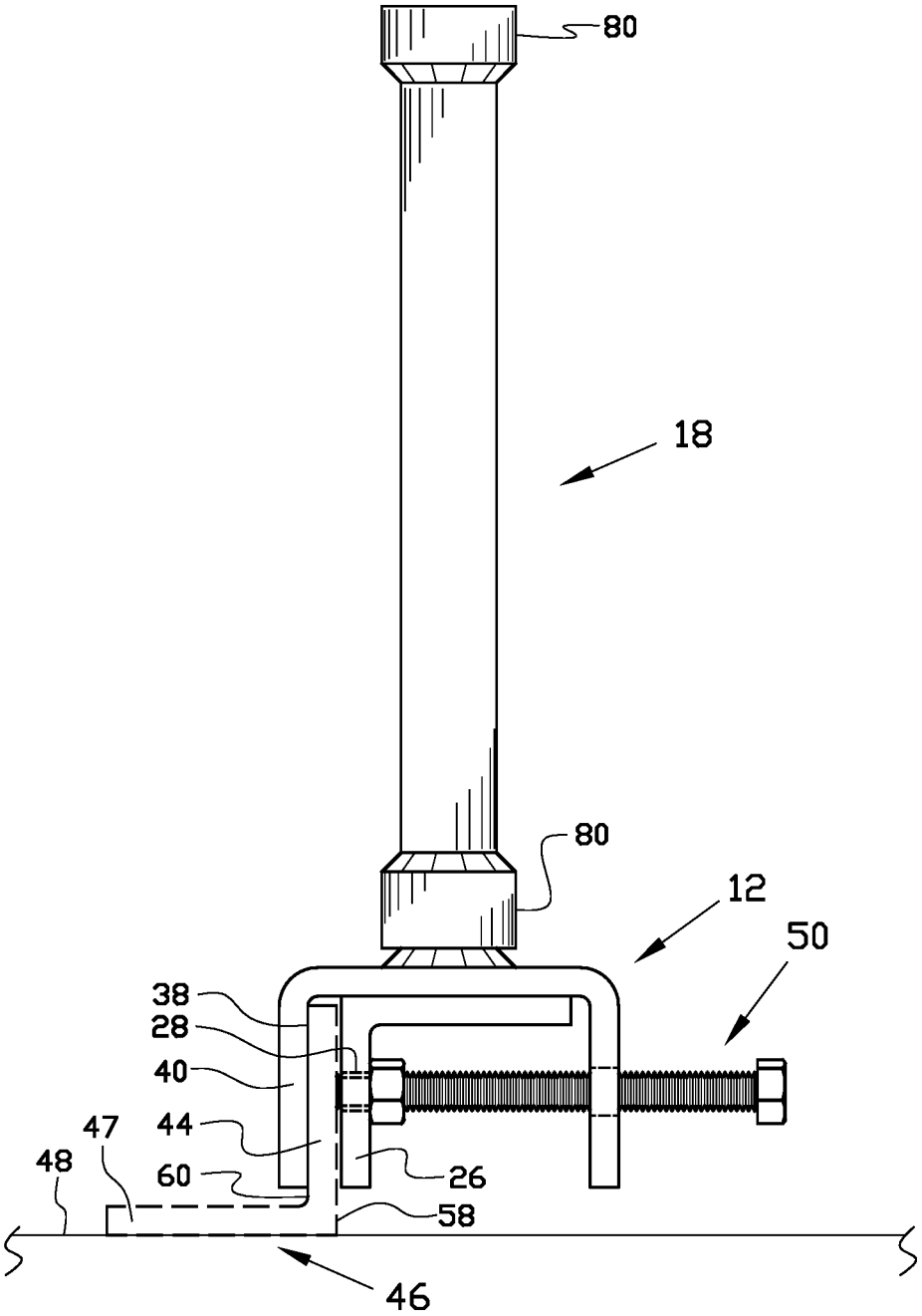
FIG. 3B is the left-side elevation view of the device of FIG. 3A, but with the device disposed upon the pour stop via insertion into the gap in the device with the bolt member engaging the pour stop in accordance with the present invention.
Figure 3C:
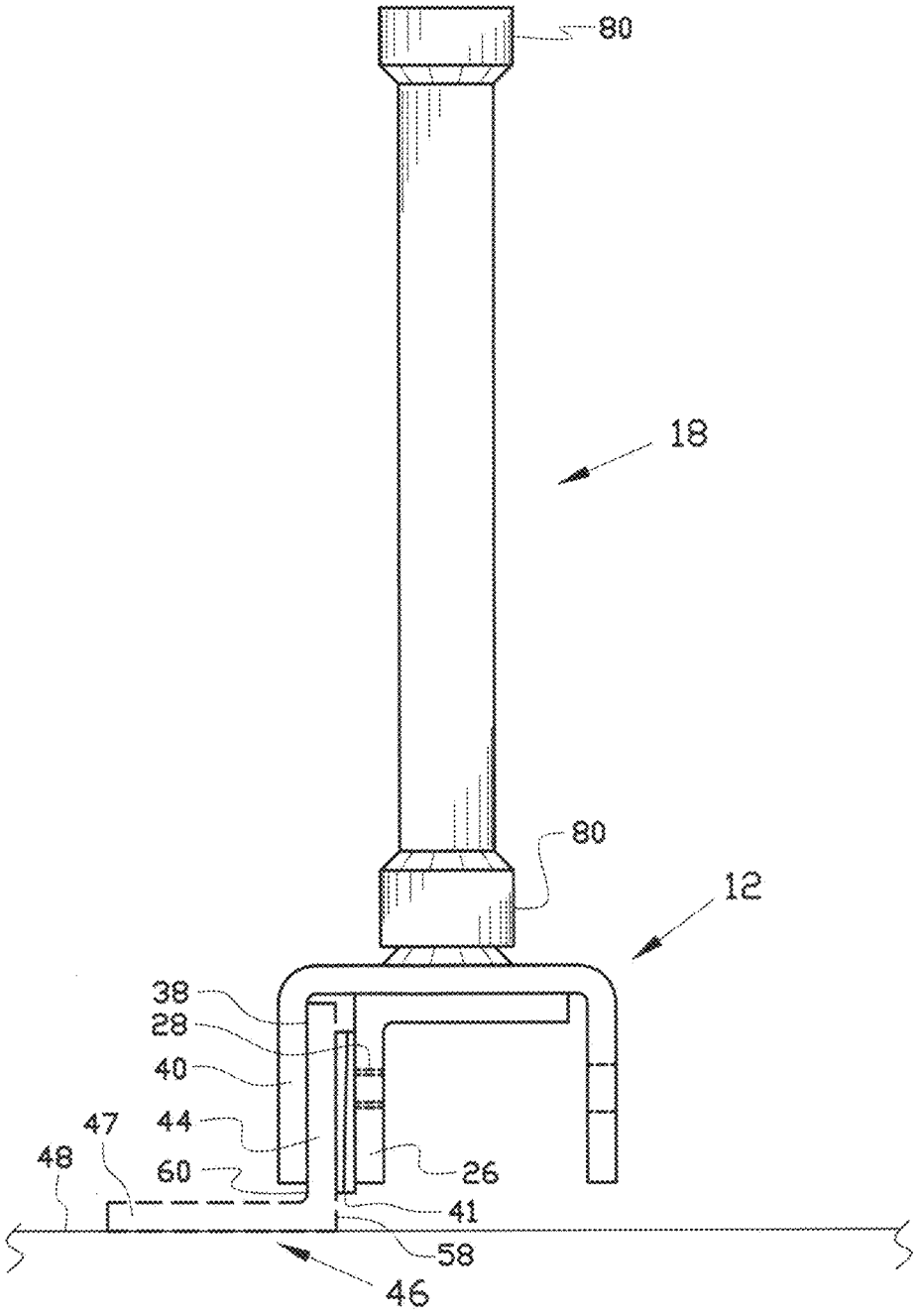
FIG. 3C is the left-side elevation view of the device of FIG. 3A, but with the bolt member removed and shims added.
Figure 4:
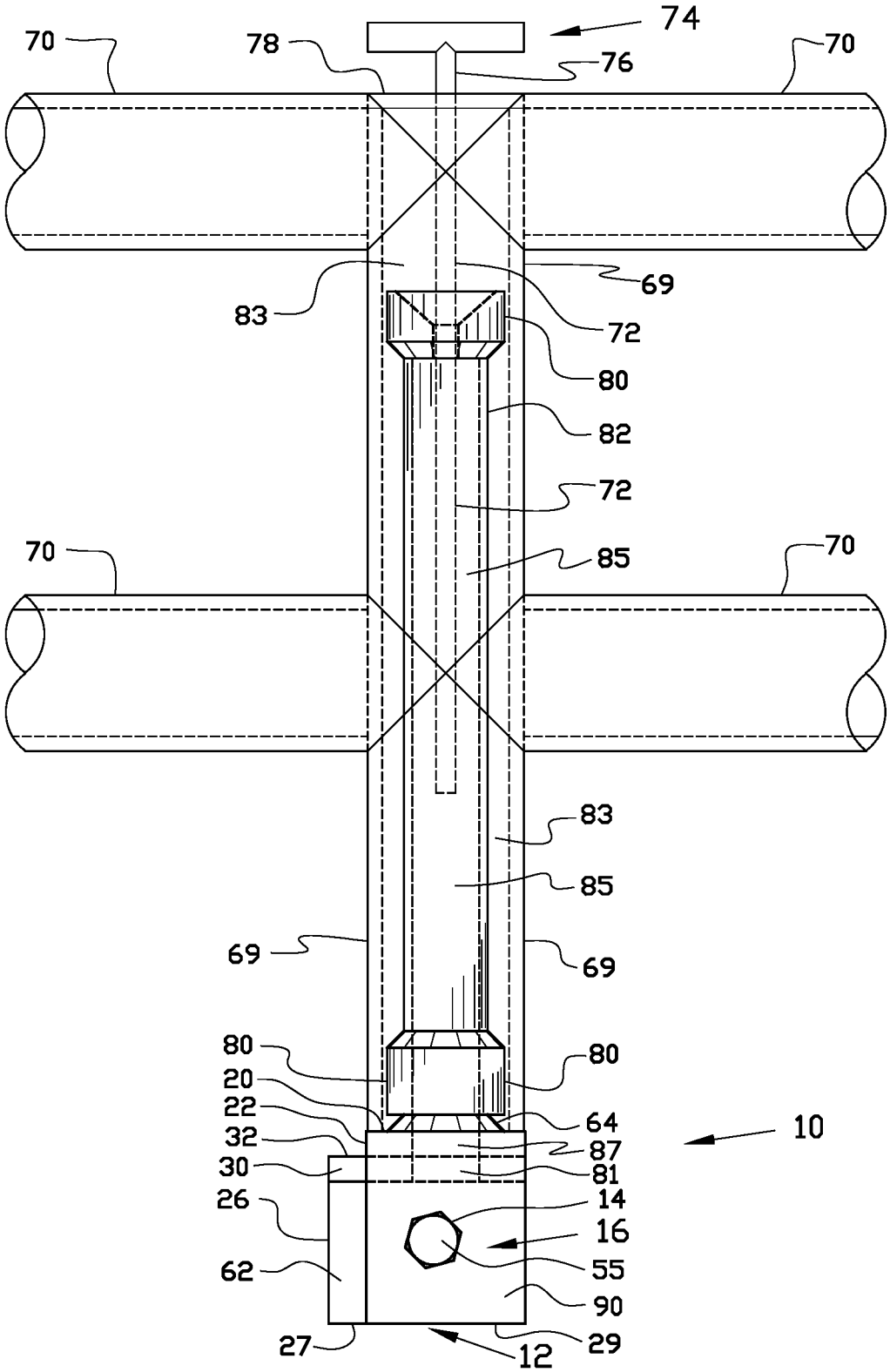
FIG. 4 is a front elevation view of the device of FIG. 1 with a guardrail section disposed upon the Device in accordance with the present invention.
Figure 5:
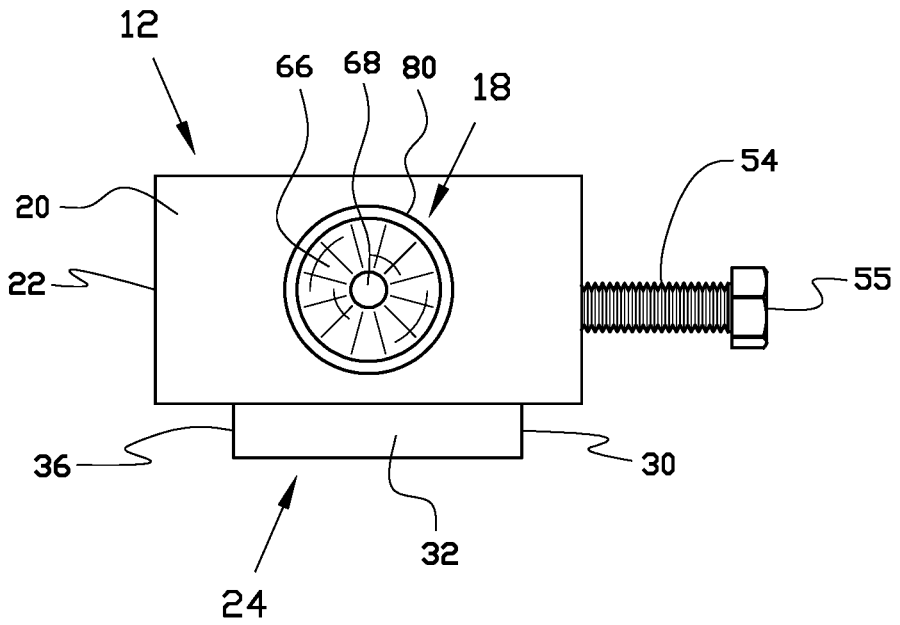
FIG. 5 is a top plan view of the device of FIG. 3.
Figure 6:
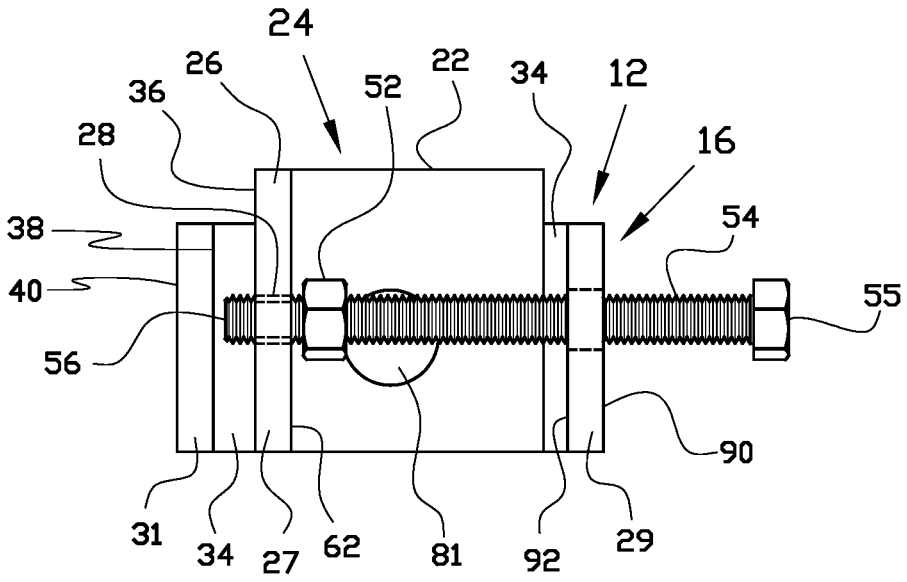
FIG. 6 is a bottom plan view of the device of FIG. 3.

Referring to FIGS. 1-6, a device for securing a guardrail to a pour stop in accordance with the present invention is denoted as numeral 10. The device 10 includes a substantially "U" configured base member 12 (when taking a side elevation view of the device 10) having an aperture 14 in a first side portion 16; a stanchion member 18 perpendicularly and integrally secured to, via a weld 64 or similar securing means, a top wall 20 of a top portion 22 of the base member 12; and an angle member 24 having a side portion 26 with a threaded aperture 28 and having a top portion 30 with a top wall 32 integrally joined, via welding or similar means, to a bottom wall 34 of the top portion 22 of the base member 12. The side portion 26 of the angle member 24 includes an outer wall 36 disposed substantially parallel to and separated from an inner wall 38 of a second side portion 40 of the base member 12, thereby forming a gap 42 for receiving a top portion 44 of a pour stop 46 having a bottom portion 47 secured to a surface 48 that receives a deformable material that ultimately solidifies.

The side portion 26 of the angle member 24 includes a longitudinal dimension that disposes a bottom end wall 27 of the side portion 26 in planar alignment with respective end walls 29 and 31 of the first and second side portions 16 and 40 of the base member 12, thereby providing a guide for top portion 44 of the pour stop 46 to insert between the second side portion 40 of the base member 12 and the side portion 26 of the angle member 24 when the device 10 is disposed upon the pour stop 46. The threaded aperture 28 in the side portion 26 of the angle member 24 is disposed at a midportion of the side portion 26 of the angle member 24.

The device 10 further includes a bolt member 50 for securing the position of the device 10 upon the pour stop 46. The bolt member 50 slidably inserts through the aperture 14 in the first side portion 16 of the base member 12, the bolt member 50 then rotationally inserts through the threaded aperture 28 in the in the side portion 26 of the angle member 24. The aperture 14 in the first side portion and the threaded aperture 28 in the side portion 26 cooperate to maintain the bolt member 50 substantially axially aligned with the threaded aperture 28 as the bolt member 50 is forcibly rotated into the threaded aperture 28, thereby preventing the bolt member 50 threads from cross-threading with the inner threads of the aperture 28 in the side portion 26.

To secure the position of the bolt member 50 relative to the angle member 24 and the pour stop 46, a locking nut 52 is rotationally disposed upon a threaded shank portion 54 of the bolt member 50 at a predetermined distance from an end wall 56 of the bolt member 50 that promotes engagement between the end wall 56 of the bolt member 50 and inner wall 58 of the top portion 44 of the pour stop 46. The shank portion 54 of the bolt member 50, the aperture 14 in the first side portion 16 of the base member 12, and the threaded aperture 28 in the side portion 26 of the angle member 24 are axially aligned. The shank portion 54 further includes an axial length that disposes a head portion 55 of the bolt member 50 from an outer wall 90 of the first side portion 16 of the base member 12 a distance greater than the distance separating the outer wall 90 of the first side portion 16 of the base member 12 and the inner wall 38 of the second side portion 40 of the base member 12, thereby enabling the gap 42 to receive pour stops 46 having varying top portions 44 with varying dimensions between inner and outer walls 58 and 60 of the top portions 44 of different pour stops 46. The axial length of the shank portion 54 prevents the head portion 55 from obstructing the axial insertion of the bolt member 50 to a position that urges the inner wall 38 of the second side portion 40 of the base member 12 into forcible engagement with the outer wall 36 of the side outer wall 60 of the top portion 44 of the pour stop 46. Further, the axial length positions the head portion 55 outside the base member 12 thereby providing access for a tool to forcibly rotate the bolt member 50.

When the device 10 is disposed upon the pour stop 46 with the gap 42 receiving the top portion 44 of the pour stop 46, the bolt member 50 is rotationally inserted into the threaded aperture 28 in the side portion 26 of the angle member 24 until the end wall 56 of the bolt member 50 engages an inner wall 58 of the pour stop 46; whereupon, the continued rotational insertion of the bolt member 50 into the threaded aperture 28 in the side portion 26 of the angle member 24 ultimately urges the inner wall 38 of the second side portion 40 of the base member 12 into forcible engagement with an outer wall 60 of the top portion 44 of the pour stop 46. The locking nut 52 is then rotationally urged into forcible engagement with an inner wall 62 of the side portion 26 of the angle member 24 thereby securing the device 10 upon the pour stop 46. A washer (not depicted) can be slidably disposed upon the shank portion 54 and positioned between the inner wall 62 of the side portion 26 of the angle member 24 and the locking nut 52 to prevent the inner wall 62 from deforming when the locking nut 52 forcibly engages the inner wall 62.

Another alternative to using the bolt member 50 to urge the inner wall 38 of the second side portion 40 of the base member 12 into forcible engagement with an outer wall 60 of the top portion 44 of the pour stop 46 to secure the device 10 upon the pour stop 46, is to use a bolt member 50 having a relatively short axial dimension for the shank portion 54 for rotationally inserting the bolt member 50 through only the threaded aperture 28 in the side portion 26 of the angle member 24, thereby avoiding insertion through the aperture 14 in the first side wall 16 of the base member 12. Upon disposing the device 10 upon the pour stop 46 (or an angle iron configured substantially the same as the depicted pour stop) via the gap 42 receiving the top portion 44 of the pour stop 46; the bolt member 50 having a short axial dimension is rotationally inserted into the threaded aperture 28 in the side portion 26 of pour stop 46 or angle member until an end wall 56 of the bolt member 50 engages an inner wall 58 of the pour stop 46. The continued rotational insertion of the bolt member 50 into the threaded aperture 28 in the side portion 26 of the angle member 24 ultimately urges the inner wall 38 of the second side portion 40 of the base member 12 into forcible engagement with an outer wall 60 of the top portion 44 of the pour stop 46 or angle iron. However, the short axial dimension bolt member 50 positions the head portion 55 under the base member 12 causing difficulty for a user to rotate the head portion 55 and the locking nut 52 to maintain the device 10 upon the pour stop 46.

Yet another alternative to using the bolt member 50 to urge the inner wall 38 of the second side portion 40 of the base member 12 into forcible engagement with an outer wall 60 of the top portion 44 of the pour stop 46 to secure the device 10 upon the pour stop 46, is to forcibly insert at least one shim 41 (well known to those of ordinary skill in the art) into the gap 42 after disposing the base and angle members 12 and 24 upon the pour stop 46. The forcible insertion of the at least one shim 41 into the gap 42 between an inner wall 58 of the top portion 44 of the pour stop 46 and an outer wall 36 of a side portion 26 of the angle member 24, cooperatively urges the inner wall 38 of the second side portion 40 of the base member 12 into forcible engagement with an outer wall 60 of the top portion 44 of the pour stop 46. The at least one shim 41 cooperates with the side portion 26 of the angle member 24 and the inner wall 38 of the second side portion 40 of the base member 12 to secure the device 10 upon the top portion 44 of the pour stop 46.

The stanchion member 18 is a steel pipe having an inner diameter and longitudinal dimensions that promote a stable guardrail section 70 (the entire guardrail ultimately constructed upon the pour stop 46 is not depicted) when a tube portion 69 of the section 70 is slidably and snugly disposed upon the stanchion member 18. The stanchion member 18 further includes a top portion having a funnel configured cover 66 with a threaded aperture 68 disposed in a central portion of the cover 66. After the device 10 is secured to the pour stop 46, upper and lower outer wall portions 80 of the stanchion member 18 slidably and snugly receive a cooperating inner wall of the tube portion 69 of the guardrail section 70. The outer wall portions 80 are separated a distance determined by the axial dimension of a midportion 82 of the stanchion member 18, thereby reducing the friction and resistance when disposing the tube portion 69 upon the stanchion member 18 and providing a sufficient engagement surface between the stanchion member 18 and tube portion 69 that maintains the guardrail section 70 in a substantially vertical position when the device 10 is secured to the pour stop 46. An inner cavity 83 of the tube portion 69, inner cavity 85 defined by inner walls 89 of the stanchion member 18, aperture 87 in the top portion of the base member 12 and an aperture 81 in the top portion 30 of the angle member 24 cooperate to allow water to drain from the device 10 when secured to the pour stop 46 and supporting the guardrail section 70.

The tube portion 69 is secured upon the stanchion member 18 via a threaded securing rod 72 (well known to those of ordinary skill in the art for securing a guardrail section 70 to a stanchion member 18) slidably inserted through an aperture (not depicted) in a central top portion 78 of the tube portion 69 of the guardrail section 70 a predetermined distance. The securing rod 72 is then rotationally urged into the threaded aperture 68 of the cover 66 via a handle portion 74 integrally having a bottom portion 76 joined to the securing rod 72, the bottom portion 76 promoting manually gripping of the handle portion 74 to rotationally urge the securing rod 72 into the threaded aperture 68 in the central portion of the funnel configured cover 66 of the stanchion member 18. The securing rod 72 is rotationally inserted into the stanchion member 18 until the bottom portion 76 of the handle portion 74 engages the top portion 78 of the tube portion 69 of the guardrail section 70, thereby rigidly and detachably securing the guardrail section 70 to the stanchion member 18, resulting in the guardrail section 70 being rigidly and detachably secured to the pour stop 46.

Figure 7:
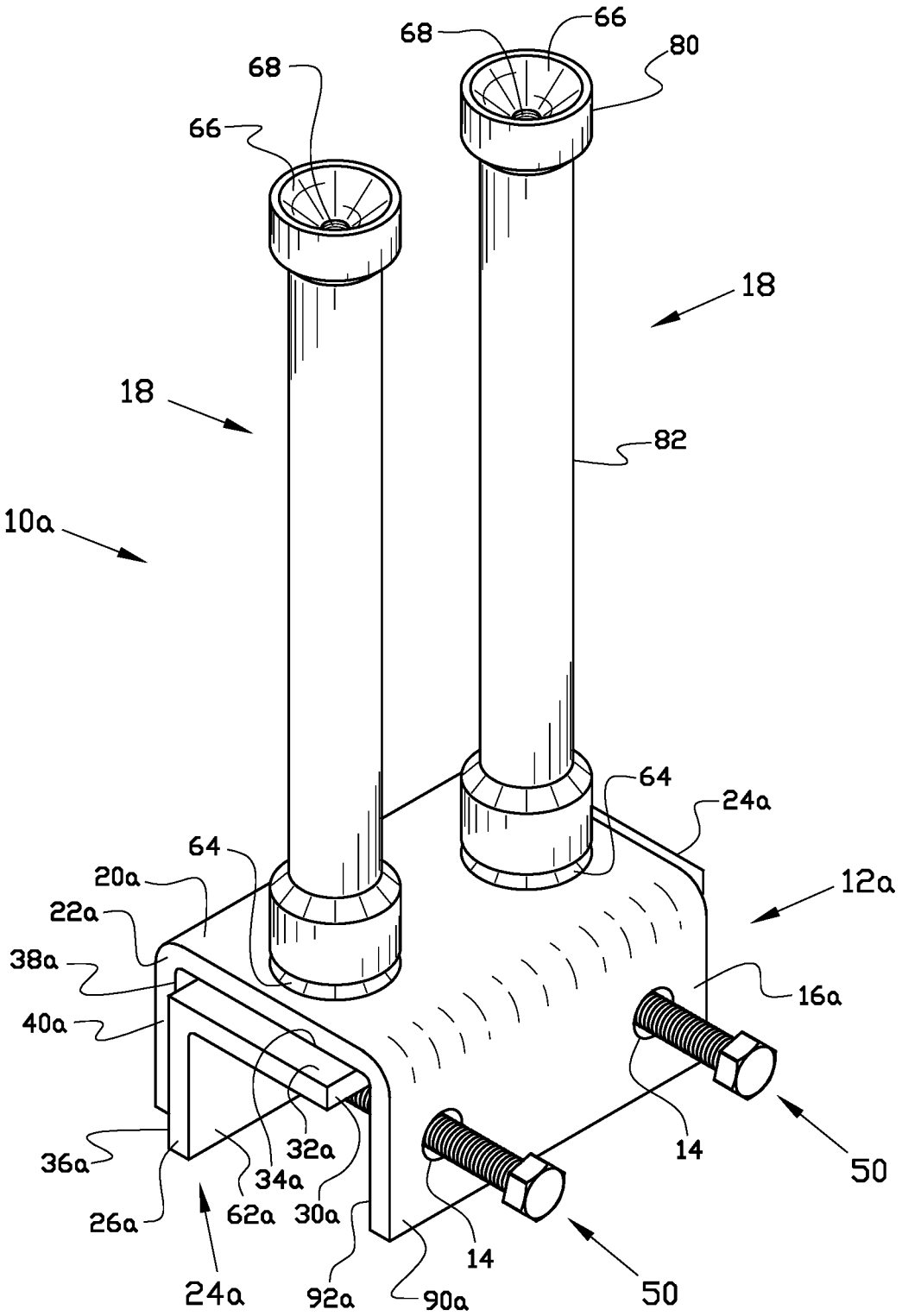
FIG. 7 is a front perspective view of a modified device for securing a guardrail section to a pour stop in accordance with the present invention.
Figure 8:
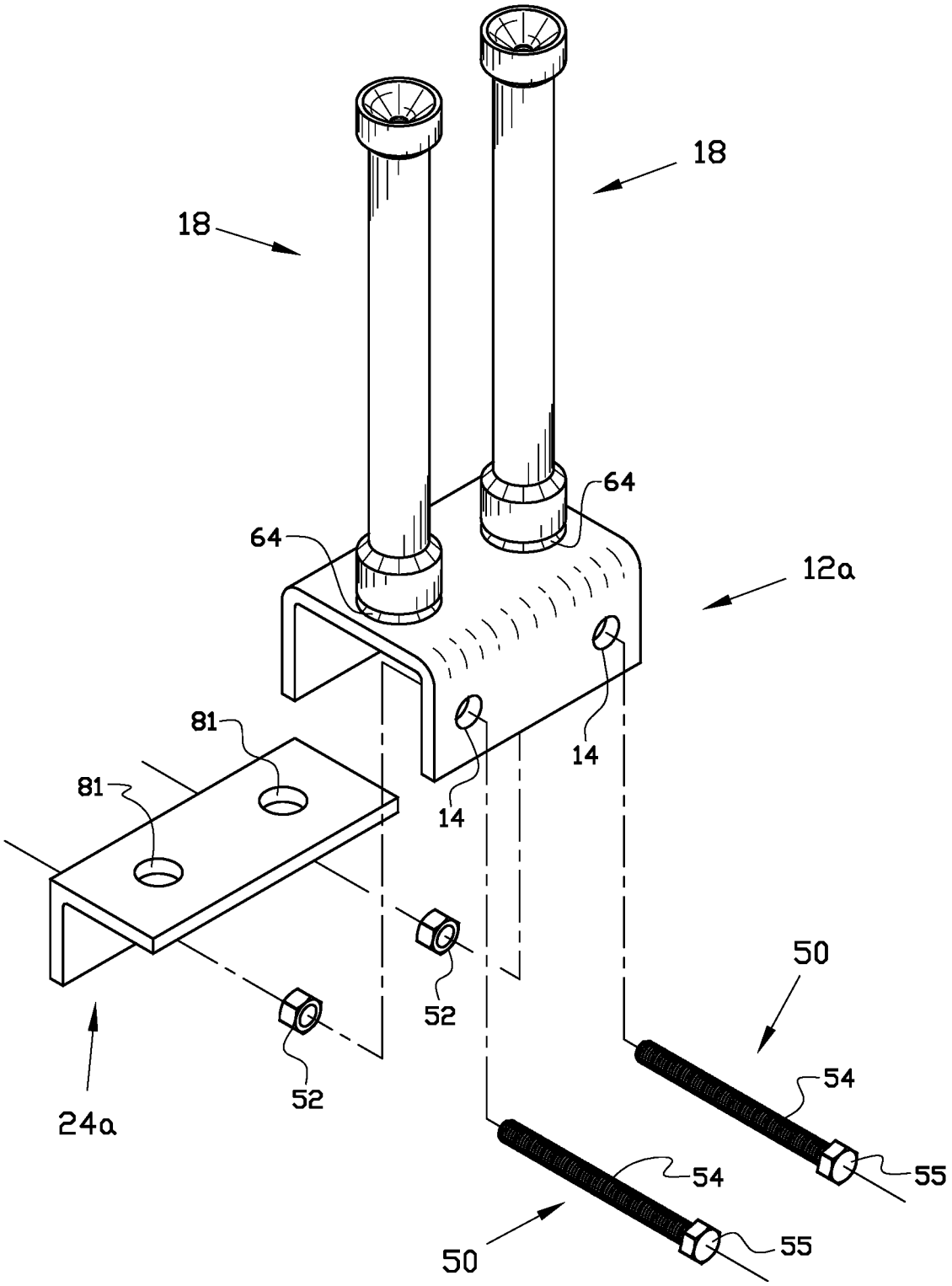
FIG. 8 is an exploded view of the modified device of FIG. 7.
Figure 9:
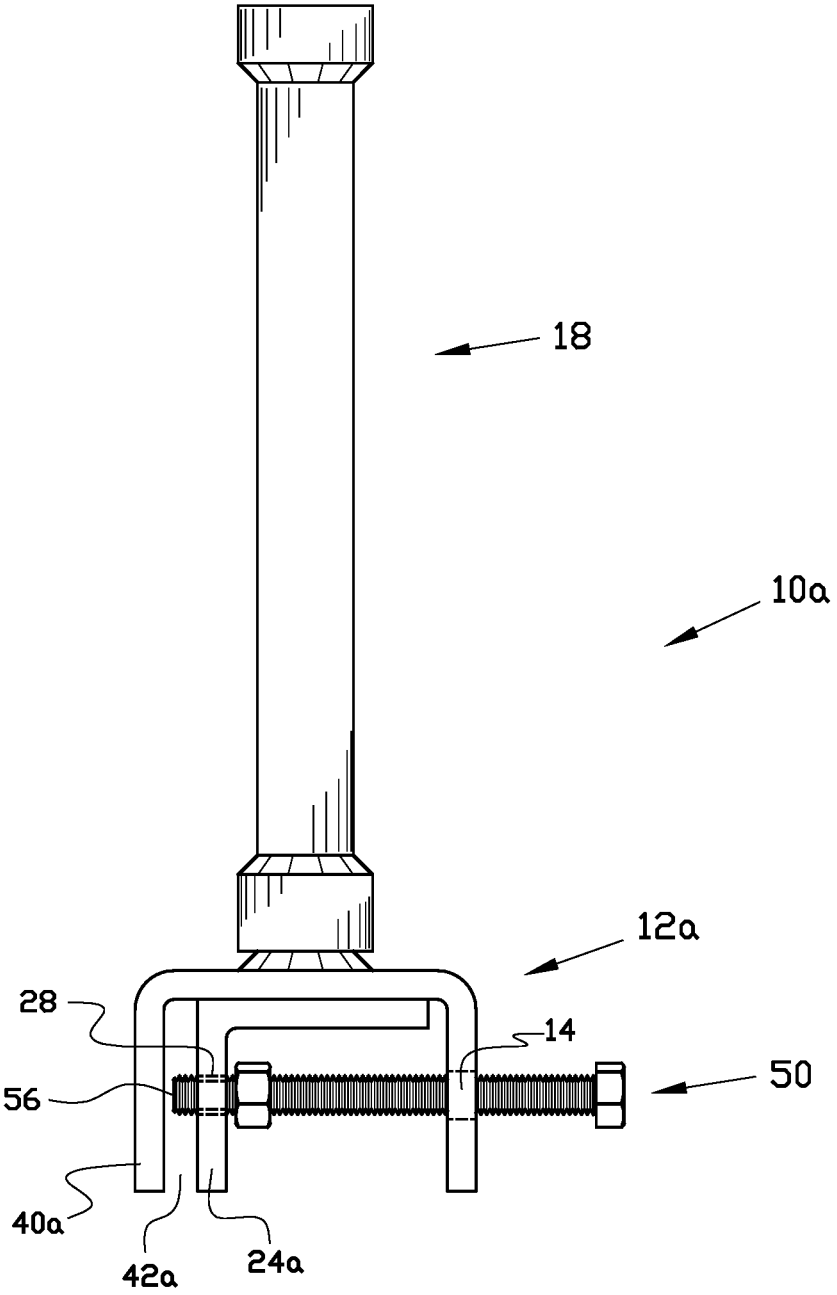
FIG. 9 is a left-side elevation view of the modified device of FIG. 7.
Figure 9A:
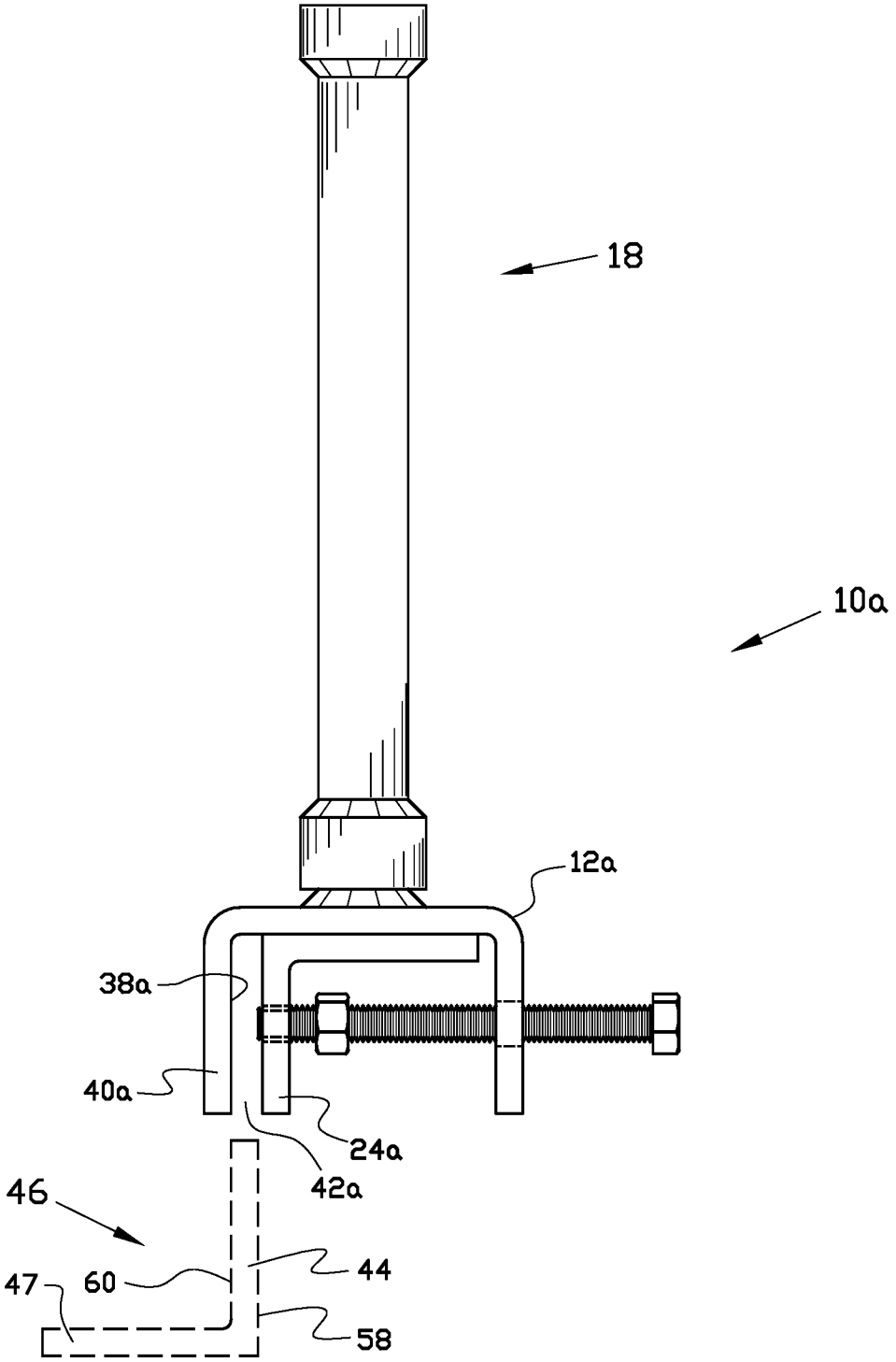
FIG. 9A is a left-side elevation view of the modified device of FIG. 9 disposed above a pour stop to be inserted into a gap in the modified device which includes two bolt members having a relatively long axial dimension in accordance with the present invention.
Figure 9B:
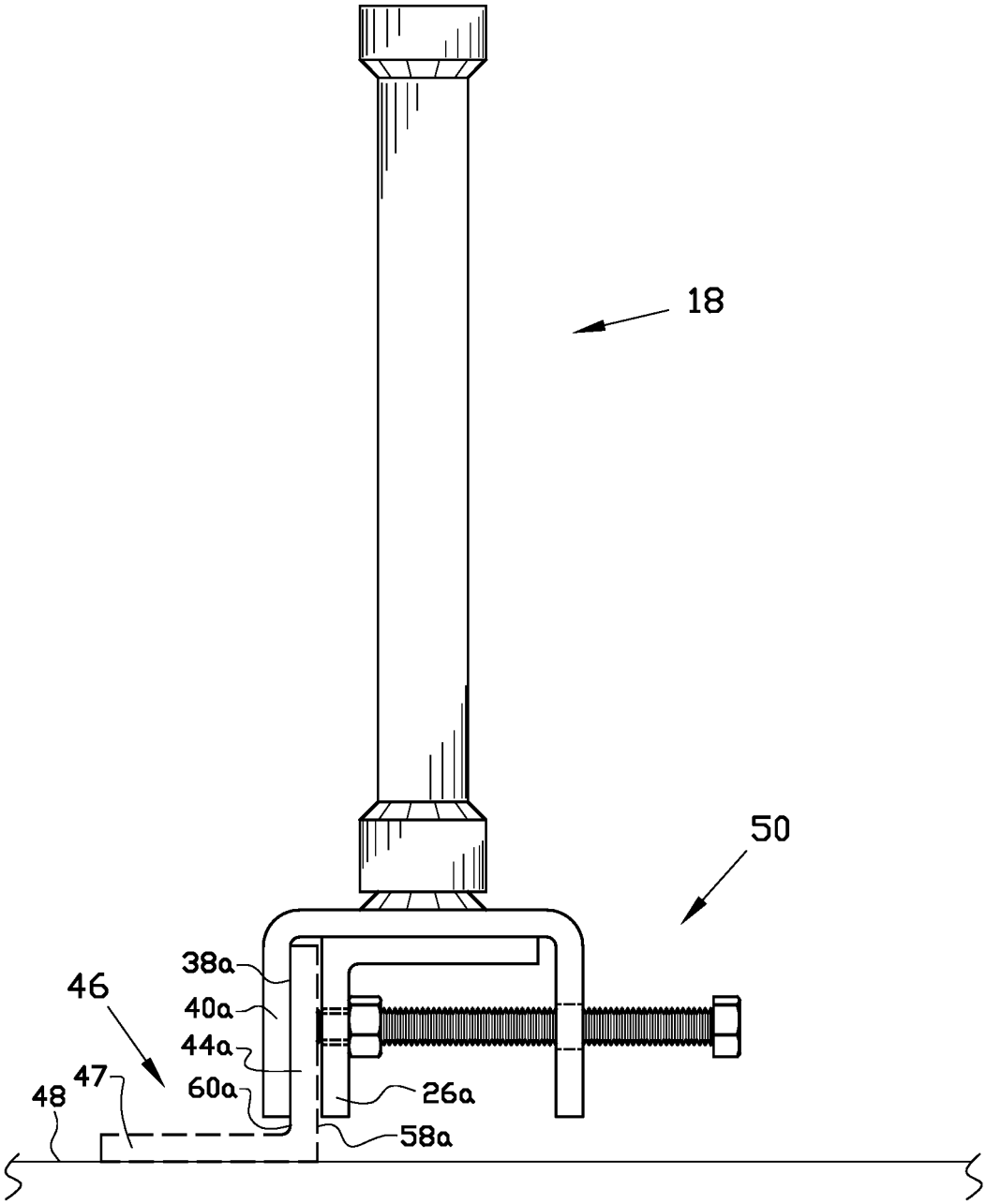
FIG. 9B is the left-side elevation view of the modified device of FIG. 9A, but with the modified device disposed upon the pour stop inserted into the gap in the modified device with the bolt member engaging the pour stop in accordance with the present invention.
Figure 10:
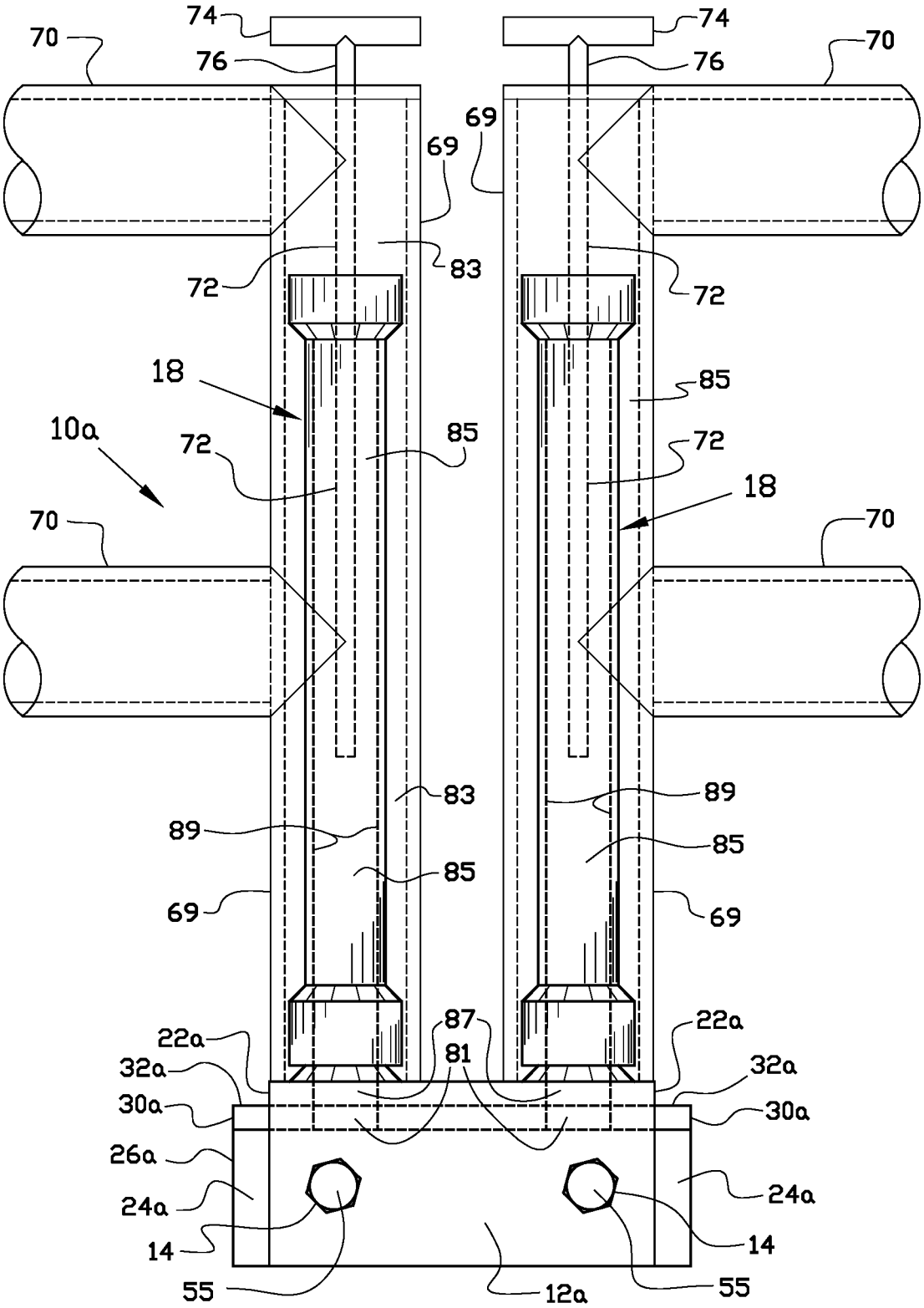
FIG. 10 is a front elevation view of the modified device of FIG. 7 with two separated guardrail sections disposed upon the device in accordance with the present invention.
Figure 11:
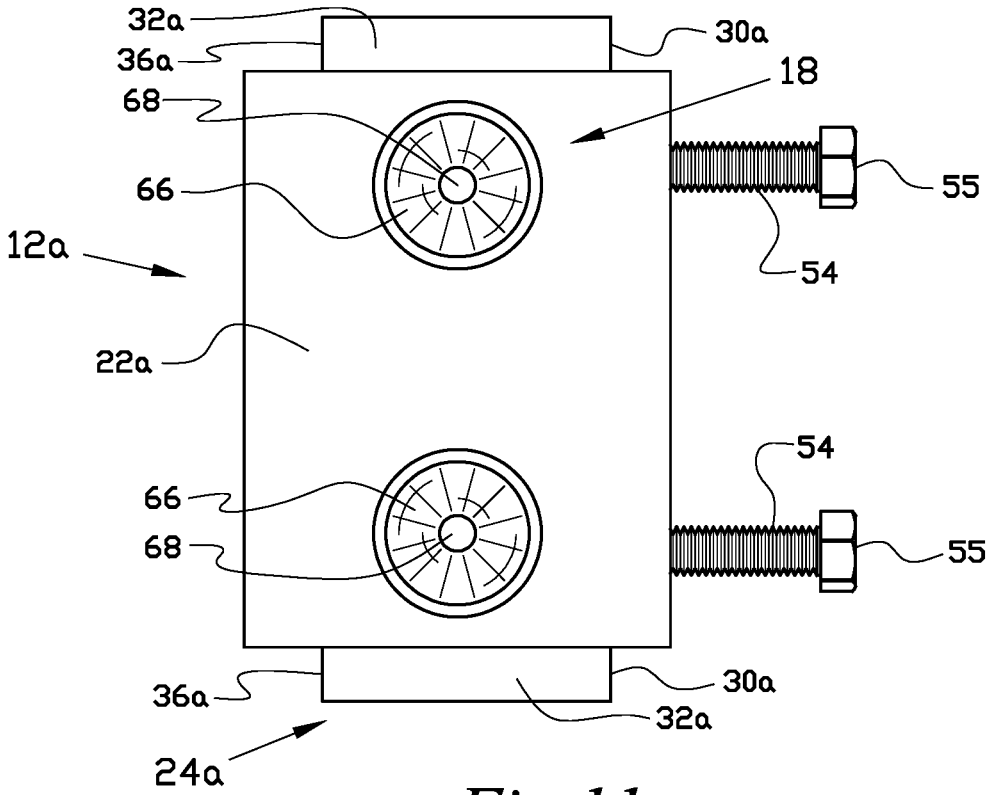
FIG. 11 is a top plan view of the modified device of FIG. 9.
Figure 12:
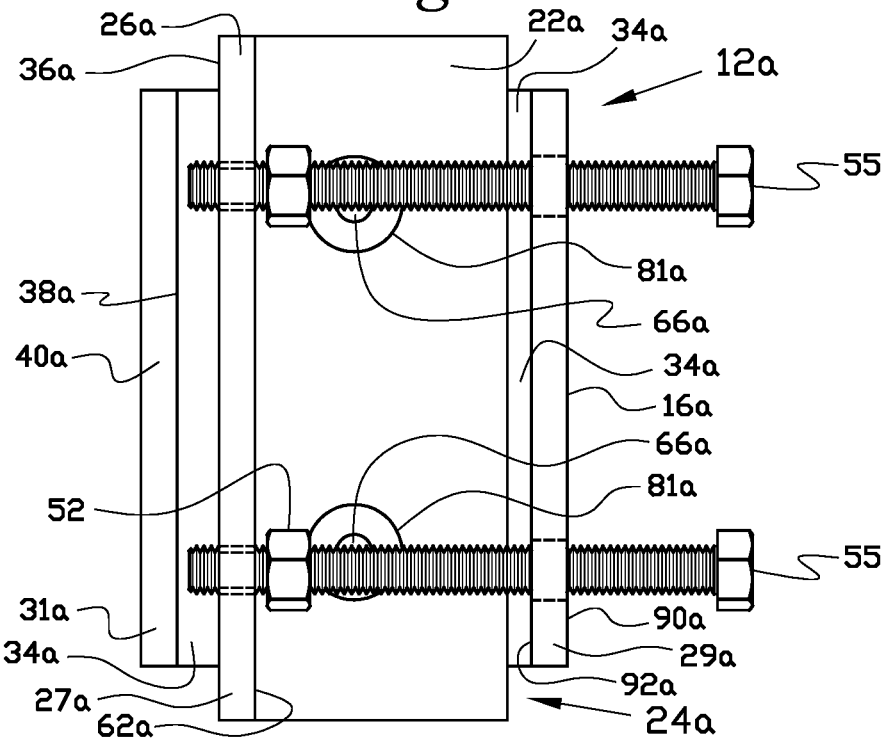
FIG. 12 is a bottom plan view of the modified device of FIG. 9.

Although the preferred device 10 includes one stanchion member 18, a modified device 10*a* that includes two stanchion members 18 (see FIGS. 7-12) integrally secured to a modified base member 12*a*, dimensioned to receive the two stanchion members 18 and a cooperating modified angle member 24*a*, ultimately secures two separate guardrail sections 70 to the pour stop 46. The two adjacent stanchion members 18 slidably receive respective tube portions 69 secured to two separate and adjacently disposed guardrail sections 70 that are ultimately secured to the pour stop 46 via the modified device 10*a*. Using the modified device 10*a* in place of two adjacently disposed and separated devices 10, reduces the time required to secure the adjacently disposed guardrail sections 70 to the two stanchion members 18 by "automatically" providing a distance of separation between respective tube portions 69 of two separate guardrail sections 70 slidably disposed upon respective stanchion members 18. The constant distance separating adjacently disposed guardrail sections 70 upon the pour stop 46 promotes user safety. The tube portion 69, stanchion member 18 and an apertures 81*a* in the top portion 30*a* of the angle member 24*a* cooperate to allow water to drain from the device 10*a* when secured to the pour stop 46 and supporting the guardrail 70.

The base member 12*a* for the modified device 10 a includes a "U" configuration (when taking a side elevation view of the device 10*a*) having apertures 14 in a first side portion 16*a*; a stanchion member 18 integrally secured, via a weld 64 or similar securing means, to a top wall 20*a* of a top portion 22*a* of the base member 12*a*; and an angle member 24*a* having a side portion 26*a* with threaded apertures 28 and having a top portion 30*a* with a top wall 32*a* integrally joined, via welding or similar means, to a bottom wall 34*a* of the top portion 22*a* of the base member 12*a*, whereby an outer wall 36*a* of the side portion 26*a* of the angle member 24*a* is disposed substantially parallel to and separated from an inner wall 38*a* of a second side portion 40*a* of the base member 12*a*, thereby forming a gap 42*a* for receiving a top portion 44 of a pour stop 46 secured to a surface 48 that receives a deformable material that ultimately solidifies.

The side portion 26*a* of the angle member 24*a* includes a longitudinal dimension that disposes a bottom end wall 27*a* of the side portion 26*a* in planar alignment with respective end walls 29*a* and 31*a* of the first and second side portions 16*a* and 40*a* of the base member 12*a*, thereby providing a guide for top portion 44 of the pour stop 46 to insert between the second side portion 40*a* of the base member 12*a* and the side portion 26*a* of the angle member 24*a* when the modified device 10*a* is disposed upon the pour stop 46. The threaded apertures 28 in the side portion 26*a* of the angle member 24*a* are disposed at a midportion of the side portion 26*a* of the angle member 24*a*.

The modified device 10*a* further includes bolt members 50 that slidably inserts through the apertures 14 in the first side portion 16*a* of the base member 12*a*, then rotationally inserts through the threaded apertures 28 in the side portion 26*a* of the angle member 24*a*. The apertures 14 in the first side portion 16*a* and the threaded apertures 28 in the side portion 26*a* of the angle member 24*a* cooperate to maintain the bolt members 50 axially aligned with the threaded apertures 28 as the bolt members 50 are forcibly rotated into the threaded apertures 28, thereby preventing the bolt member 50 threads from cross-threading with the inner threads in the side portion 26*a*.

To secure the position of the bolt members 50 relative to the angle member 24*a* and the pour stop 46, locking nuts 52 are rotationally disposed upon threaded shank portions 54 of the bolt members 50 at a predetermined distance from an end wall 56 of the bolt members 50 that promotes engagement between the end walls 56 of the bolt members 50 and inner wall 58 of the top portion 44 of the pour stop 46. The shank portions 54 of the bolt members 50, the apertures 14 in the first side portion 16*a* of the base member 12*a*, and the threaded apertures 28 in the side portion 26*a* of the angle member 24*a* are axially aligned. The shank portion 54 further includes an axial length that disposes a head portion 55 of the bolt member 50 from an outer wall 90*a* of the first side portion 16*a* of the base member 12*a* a distance greater than the distance separating the outer wall 90*a* of the first side portion 16*a* of the base member 12*a* and the inner wall 38*a* of the second side portion 40*a* of the base member 12*a*, thereby enabling the gap 42*a* to receive pour stops 46 having varying top portions 44 with varying dimensions between inner and outer walls 58 and 60 of the top portions 44 of different pour stops 46.

When the modified device 10*a* is disposed upon the pour stop 46 with the gap 42*a* receiving the top portion 44 of the pour stop 46, the bolt members 50 are rotationally inserted into the threaded apertures 28 in the side portion 26*a* of the angle member 24*a* until the end walls 56 of the bolt members 50 engages an inner wall 58 of the pour stop 46; whereupon, the continued rotational insertion of the bolt members 50 into the threaded apertures 28 in the side portion 26*a* of the angle member 24*a* ultimately urge the inner wall 38*a* of the second side portion 40*a* of the base member 12*a* into forcible engagement with an outer wall 60 of the top portion 44 of the pour stop 46. The locking nuts 52 are then rotationally urged into forcible engagement with an inner wall 62*a* of the side portion 26*a* of the angle member 24*a* thereby securing the modified device 10*a* upon the pour stop 46. A washer (not depicted) can be slidably disposed upon the shank portions 54 and positioned between the inner wall 62*a* of the side portion 26*a* of the angle member 24*a* and the locking nuts 52 to prevent the inner wall 62*a* from deforming when the locking nuts 52 forcibly engage the inner wall 62*a*.

The invention claimed is:

1. Device for securing a guardrail to an L-shaped pour stop for a deformable material that solidifies comprising:

a substantially U configured base member having an aperture in a first side portion;

a stanchion member integrally secured to a top wall of a top portion of said base member, said top wall having a surface area sufficient to engage an entire bottom portion of said stanchion member, said stanchion member ultimately receiving a guardrail;

an L-shaped angle member fixed between the first side portion and a second side portion of said base member, having a side portion with a threaded aperture, and having a top portion with a top wall integrally joined to a bottom wall of said top portion of said base member, whereby an outer wall of said side portion of said angle member is disposed substantially parallel to and separated from an inner wall of the second side portion of said base member, thereby forming a fixed gap dimensioned slightly larger than a width of a vertical portion of said pour stop received within the fixed gap, said fixed gap dimension being substantially smaller than the dimension separating said inner wall of said second side portion of said base member from an inner wall of said first side portion of said base member and the dimension separating said inner wall of said first side portion of said base member from an inner wall of said side portion of said angle member, thereby minimizing the distance said inner wall of said second side portion of said base member traverses to engage said outer wall of said vertical portion of said pour stop, and enabling said inner walls of said first and second side portions of said base member to be separated a distance that enable a bottom portion of said stanchion member to be integrally joined to said top wall of said top portion of said base member, said stanchion member bottom portion having a diameter substantially greater than said fixed gap dimension; and a bolt member that slidably inserts through said aperture in said first side portion of said base member, said bolt member ultimately rotationally inserting through said threaded aperture in said side portion of said angle member; whereby, upon disposing said device upon the pour stop with said fixed gap receiving the vertical portion of the pour stop, said bolt member is rotationally inserted into said threaded aperture in said side portion of said angle member until an end wall of said bolt member engages an inner wall of the pour stop; whereupon, the continued engagement of said end wall of said bolt member with the inner wall of the pour stop combined with the rotational insertion of said bolt member into said threaded aperture in said side portion of said angle member, ultimately urges said inner wall of said second side portion of said base member into forcible engagement with an outer wall of the vertical portion of the pour stop, thereby detachably securing said device to the pour stop and ultimately enabling the guardrail to be detachably secured to said stanchion member.

2. The device of claim 1 wherein said bolt member includes a locking nut rotationally disposed upon a threaded shank portion of the bolt member, whereby the locking nut is rotationally urged into forcibly engagement with the inner wall of said side portion of said angle member, thereby securing said device upon the vertical portion of the pour stop, the top portion of the pour stop having inner and outer walls separated a distance of about one-quarter of an inch.

3. The device of claim 1 wherein said stanchion member is welded to said top wall of said top portion of said base member.

4. The device of claim 1 wherein said cover member secured to a top portion of said stanchion member includes a funnel configured top portion having a centrally disposed threaded orifice for rotationally receiving a threaded securing rod that rotationally inserts into said threaded orifice a predetermined distance to secure a predetermined guardrail upon said stanchion member.

5. The device of claim 4 wherein the securing rod is integrally joined to a manually rotated handle for rotationally urging the securing rod through said orifice until a bottom portion of the manually rotated handle engages a top portion of a tube portion of the guardrail.

6. The device of claim 1 wherein said top wall of said top portion of said angle member is welded to said bottom wall of said top portion of said base member.

7. The device of claim 1 wherein said side portion of said angle member includes a longitudinal dimension that disposes a bottom end wall of said side portion in planar alignment with respective end walls of said first and second side portions of said base member, thereby providing a guide for the top portion of the pour stop to insert between said second side portion of said base member and said side portion of said angle member when said device is disposed upon the pour stop.

8. The device of claim 1 wherein said shank portion of said bolt member and said aperture in said first side portion of said base member and said threaded aperture in said side portion of said angle member are axially aligned.

9. The device of claim 1 wherein said threaded aperture in said side portion of said angle member is disposed at a midportion of said side portion of said angle member.

10. The device of claim 1 wherein said threaded shank portion of said bolt member includes a washer slidably disposed upon said shank portion and positioned between said inner wall of said side portion of said angle member and a locking nut.

11. The device of claim 1 wherein said shank portion of said bolt member includes an axial length that disposes a head portion of said bolt member from an outer wall of said first side portion of said base member a distance greater than the distance separating said outer wall of said first side portion of said base member and said inner wall of said second side portion of said base member, thereby enabling said gap to receive pour stops having varying vertical top portions with varying dimensions between inner and outer walls of the vertical top portions of the pour stops.

12. The device of claim 1 wherein the tube portion, stanchion member and aperture in the top portion of the angle member cooperate to allow water to drain from said device when secured to the pour stop and supporting the guardrail.

13. The device of claim 12 wherein said base member is secured to the pour stop via two bolt members engaging said angle member and a top portion of the pour stop.

14. The device of claim 1 wherein said base member includes two stanchion members integrally secured to a top wall of a top portion of said base member.

15. Guardrail securing device for an L-shaped pour stop comprising:

a substantially U configured base member having first and second side portions, said first side portion having an aperture;

a stanchion member integrally secured to a top wall of a top portion of said base member, an entire bottom portion of said stanchion member engaging said top wall of said top portion of said base member;

an L-shaped angle member fixed between the first side portion and the second side portion of said base member, having a side portion with a threaded aperture configured to receive a fastener therein, and a top portion with a top wall integrally joined to a bottom wall of said top portion of said base member, whereby an outer wall of said side portion of said angle member is disposed substantially parallel to and separated from an inner wall of the second side portion of said base member, thereby forming a fixed gap dimensioned slightly larger than a width of a vertical portion of said pour stop received within the fixed gap, said fixed gap dimension being substantially smaller than the dimension separating said inner wall of said second side portion of said base member from an inner wall of said first side portion of said base member and the dimension separating said inner wall of said first side portion of said base member from an inner wall of said side portion of said angle member, thereby minimizing the distance said inner wall of said second side portion of said base member traverses to engage said outer wall of said vertical portion of said pour stop, and enabling said inner walls of said first and second side portions of said base membe to be separated a distance that enable a bottom portion of said stanchion member to be integrally joined to said top wall of said top portion of said base member; and at least one shim forcibly inserted into said fixed gap after disposing said base and angle members upon the pour stop; whereby, said at least one shim forcibly engaging an inner wall of the vertical portion of the pour stop and the outer wall of the side portion of the angle member, whereupon, the continued insertion of said at least one shim into said fixed gap forcibly urges said inner wall of said second side portion of said base member into forcible engagement with an outer wall of the vertical portion of the pour stop, said at least one shim cooperating with said side portion of said angle member and said inner wall of said second side portion of said base member to secure said device upon the vertical portion of the pour stop, thereby enabling said stanchion member to detachably receive a guardrail.

16. The device of claim 15 wherein said top wall of said top portion of said angle member is welded to said bottom wall of said top portion of said base member.

17. The device of claim 15 wherein said side portion of said angle member includes a longitudinal dimension that disposes a bottom end wall of said side portion in planar alignment with respective end walls of said first and second side portions of said base member, thereby providing a guide for the vertical portion of the pour stop to insert between said second side portion of said base member and said side portion of said angle member when said device is disposed upon the pour stop.

18. Device for securing a guardrail to an L-shaped pour stop comprising:

a substantially U configured base member having first and second side portions, said first side comprising an aperture;

a stanchion member integrally secured to a top wall of a top portion of said base member;

an L-shaped angle member fixed between the first side portion and the second side portion of said base member, having a side portion with a threaded aperture, and having a top portion with a top wall integrally joined to a bottom wall of said top portion of said base member, whereby an outer wall of said side portion of said angle member is disposed substantially parallel to and separated from an inner wall of a second side portion of said base member, thereby forming a fixed gap dimensioned slightly larger than a width of a vertical portion of said pour stop received within the fixed gap, said fixed gap dimension being substantially smaller than the dimension separating said inner wall of said second side portion of said base member from an inner wall of said first side portion of said base member and the dimension separating said inner wall of said first side portion of said base member from an inner wall of said side portion of said angle member, thereby minimizing the distance said inner wall of said second side portion of said base member traverses to engage said outer wall of said vertical portion of said pour stop, and enabling said inner walls of said first and second side portions of said base member to be separated a distance that enable a bottom portion of said stanchion member to be integrally joined to said top wall of said top portion of said base member, thereby enabling said top wall of said top portion of said base to engage an entire bottom portion of said stanchion member; and a bolt member that slidably inserts through said aperture in said first side portion of said base member, said bolt member ultimately rotationally inserts through said threaded aperture in said side portion of said angle member; whereby, upon disposing said device upon the pour stop via said fixed gap receiving the vertical portion of the pour stop, said bolt member is rotationally inserted into said threaded aperture in said side portion of said angle member until said end wall of said bolt member engages an inner wall of the pour stop, whereupon, the continued rotational insertion of said bolt member into said threaded aperture in said side portion of said angle member ultimately urges said inner wall of said second side portion of said base member into forcible engagement with an outer wall of the top portion of the pour stop, thereby securing said device to the pour stop and enabling a guardrail to be detachably secured to the stanchion member of said device.

19. The device of claim 18 wherein a shank portion of said bolt member includes an axial length slightly greater than the distance separating said inner wall of said second side portion of said base member and said inner wall of said side portion of said angle member, thereby enabling said fixed gap to receive varying vertical portions of pour stops having varying dimensions between inner and outer walls of the top portions of the pour stops that ultimately insert into said fixed gap.

* * * * *